US005466062A

United States Patent [19]

McPherson et al.

[11] Patent Number: 5,466,062

[45] Date of Patent: Nov. 14, 1995

[54] DRAWER FRONT

[75] Inventors: James I. McPherson, Muskegon; Daniel R. Kinney, Grand Haven; William E. Jeannot, Jr., Muskegon; Thomas R. Karel, Ravenna, all of Mich.

[73] Assignee: Herman Miller, Inc., Zeeland, Mich.

[21] Appl. No.: 17,506

[22] Filed: Feb. 12, 1993

[51] Int. Cl.[6] ..... A47B 88/00

[52] U.S. Cl. ..... 312/348.6; 16/110 R

[58] Field of Search ..... 312/204, 311, 312/332.1, 348.6, 320, 244; 220/759; 16/114 R, 110 R

[56] References Cited

U.S. PATENT DOCUMENTS

| | | | |
|---|---|---|---|
| 2,039,574 | 5/1936 | Wenderoth | 16/110 R |
| 2,771,627 | 11/1956 | Hammer . | |
| 2,793,386 | 5/1957 | Muhlhauser . | |
| 2,805,911 | 9/1957 | Anderson | 312/348.6 |
| 3,098,686 | 7/1963 | Benoit . | |
| 3,238,656 | 3/1966 | Kanzelberger . | |
| 3,412,421 | 11/1968 | Gerber . | |
| 3,646,634 | 3/1972 | Fusselman . | |
| 3,773,399 | 11/1973 | Sulcek | 312/204 |
| 3,908,225 | 9/1975 | Drilling et al. . | |
| 4,090,756 | 5/1978 | Frey et al. . | |
| 4,230,382 | 10/1980 | Wenzlick et al. . | |

FOREIGN PATENT DOCUMENTS

| | | | |
|---|---|---|---|
| 0473954 | 7/1974 | Australia | 16/110 R |
| 1255212 | 1/1961 | France . | |
| 1429684 | 1/1970 | Germany . | |

*Primary Examiner*—Kenneth J. Dorner
*Assistant Examiner*—Gerald A. Anderson
*Attorney, Agent, or Firm*—Willian Brinks Hofer Gilson & Lione

[57] ABSTRACT

The invention is directed to a drawer front having a front panel and a pull attached thereto. The front panel has a front wall with a top flange extending rearwardly from a top portion of the front wall and a back flange extending downward from the top flange. The pull has a generally inverted J-shaped cross-section. The pull has a front portion for a user to grasp with his fingers and a rear portion spaced apart from the front portion. A middle portion interconnects the front portion and the rear portion. A locking element is attached to one of the back flange of the front panel and the rear portion of the pull. A first aperture is located on the other of the back flange of the front panel and the rear portion of the pull. The locking element mates with the first aperture to thereby secure the pull to the front panel.

13 Claims, 1 Drawing Sheet

DRAWER FRONT

BACKGROUND OF THE INVENTION

The present invention relates generally to the field of file cabinet drawers and desk drawers. More particularly, the invention relates to the field of drawer pulls for use with the drawers of file cabinets, desks and the like.

File cabinet drawers and desk drawers are often designed with an integral drawer pull. However, the use of an integral drawer pull limits a manufacturer's ability to configure the pull shape and material to the particular aesthetic requirements of a user. Furthermore, the manufacture of an integral drawer pull can be a difficult process.

One type of drawer pull has been constructed for use with an aperture within the front panel of a drawer. For example, U.S. Pat. No. 3,098,686 issued to R. A. Benoit discloses a drawer pull for use in a recess or cavity in a drawer front. A box-shaped section is shaped around an aperture in the drawer front in order to form an enclosure that secures the drawer pull. The drawer pull has a curved body that fits within the cavity of the drawer front. Two oppositely extending detent portions extend from the pull in order to mate with two spaced apart flanges extending from the front of the drawer.

Similarly, U.S. Pat. No. 3,646,634 issued to Fusselman discloses a pull for use inside an aperture in the front panel of a drawer. A box-shaped housing with an open-top is attached to the rear surface of the front panel. A J-shaped trim element is attached to the upper edge of the aperture. A pair of locking tabs on the trim element mate with a downwardly extending lip from the upper edge of the aperture to thereby secure the trim element to the front panel.

One disadvantage of these types of devices is that these pulls require that an aperture be cut in the front panel of the drawer thereby adding complexity to the manufacturing process and detracting from the appearance of the drawer. Furthermore, the additional structure of a box-shaped housing may be necessary to enclose the aperture in the front panel. Another disadvantage of these pulls is that the length of these pulls is limited to the size of the corresponding aperture. Thus, a user has a much more limited space in which to grab the pull.

Therefore, a simple and more versatile drawer pull is needed.

SUMMARY OF THE INVENTION

Briefly stated, the present invention is directed to a drawer front having a front panel and a pull attached thereto. The front panel has a front wall with a top flange extending rearwardly from a top portion of the front wall and a back flange extending downward from the top flange. The pull has a generally inverted J-shaped cross-section. The pull has a front portion for a user to grasp with his fingers and a rear portion spaced apart from the front portion. A middle portion interconnects the front portion and the rear portion. A locking element is attached to one of the back flange of the front panel and the rear portion of the pull. A first aperture is located on the other of the back flange of the front panel and the rear portion of the pull. The locking element mates with the first aperture to thereby secure the pull to the front panel.

In accordance with a preferred aspect of the invention, a method of placing a pull on a front panel of a drawer front is disclosed. A users affixes a pull having a back portion with a locking element attached thereto onto a front panel. The front panel has a front wall with a top flange extending rearwardly from a top portion the front wall and a back flange extending downward from the top flange. The back flange has an aperture to allow the locking element of the pull to securely mate with the back flange thereby affixing the pull to the front panel of the drawer front.

In another preferred aspect of the invention, a method of interchanging a pull on a drawer is disclosed. A user affixes a first pull having a back portion and a locking element onto the front panel. The front panel has a front wall with a top flange extending rearwardly from a top portion of said front wall and a back flange extending downward from said top flange. The back flange has an aperture which releasable engages the locking element of the pull thereby affixing the first pull to the front panel of the drawer front. A user may subsequently remove the first pull by disengaging the locking element of the first pull from the back flange of the front panel. A second pull having a back portion and a locking element is attached to back flange of the front panel thereby securing the second pull to the front panel of the drawer front.

It is a primary object of this invention to provide a simple and more versatile drawer pull capable of being made from various materials to allow a user to easily configure the drawers of file cabinets, desks and the like as desired. This invention is more efficient and versatile than the prior art. This invention, together with attendant objects and advantages, will be best understood with reference to the detailed description below read in conjunction with the accompanying drawings.

DETAILED DESCRIPTION OF THE PREFERRED EMBODIMENTS

Figure 1:
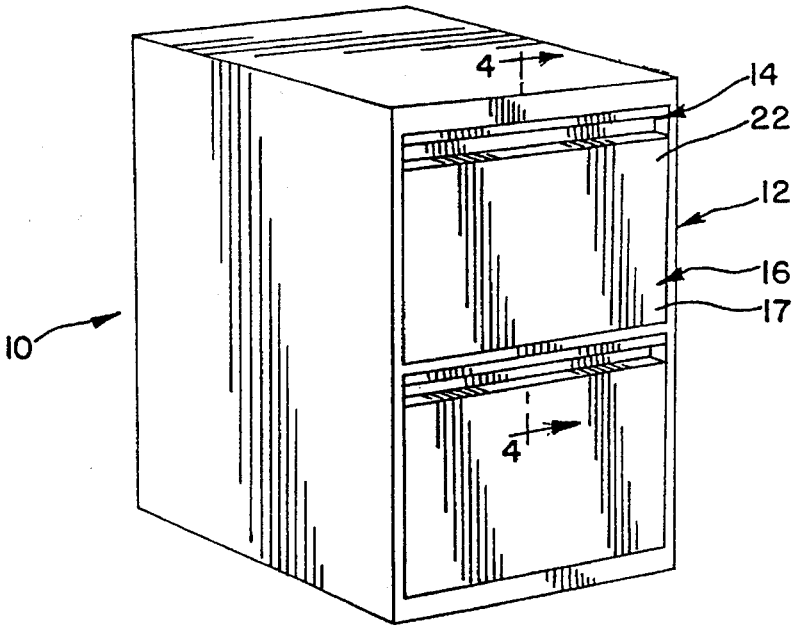
FIG. 1 is a perspective view of a file cabinet showing a preferred embodiment of the front panel and pull of the present invention.
Figure 4:
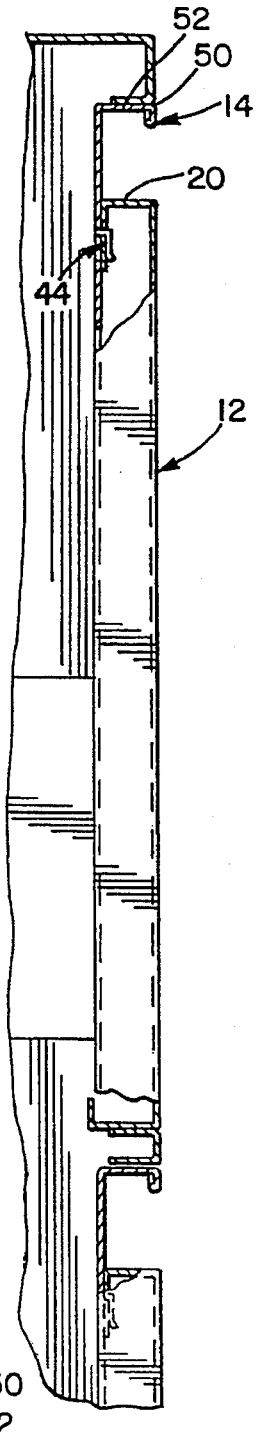
FIG. 4 is a partial cross-sectional view taken along lines 4—4 of FIG. 1.
Figure 2:
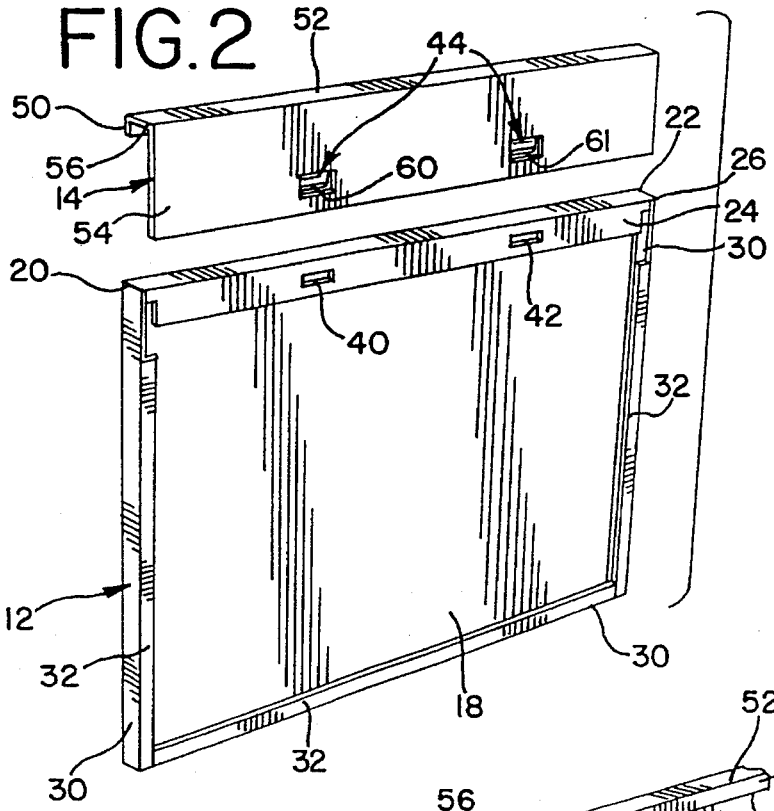
FIG. 2 is an exploded rear view of the front panel and pull as shown in FIG. 1.
Figure 3:
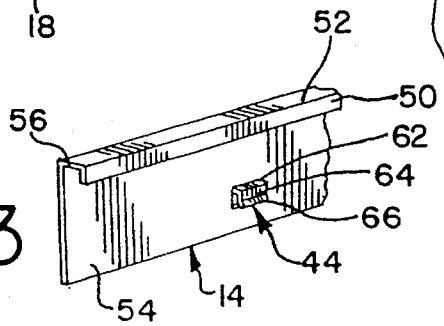
FIG. 3 is a partial front view of the pull shown FIGS. 1–2.

Referring to the drawings, FIG. 1 shows a file cabinet 10 having a front panel 12 and a pull 14 in accordance with a first preferred embodiment of the present invention. The front panel 12 has a front wall 16 with a front surface 17 and a rear surface 18. As best shown in FIG. 2, a top flange 20 extends toward the back of the cabinet from a top portion 22 of the front wall 16. A back flange 24 extends downward from a rear edge 26 of the top flange 20 spaced apart from the front wall 16 of the front panel 12.

Three side flanges 30 extend rearward from and perpendicular to the front wall 16. Three rear flanges 32 each extend inward from the side flanges 30. The rear flanges 32 are spaced apart from the front wall 16 and serve as a mounting surface in order to affix the front panel 12 to a movable tray within the file cabinet 10.

The back flange 24 has a first aperture 40 and a second aperture 42 sized to receive a locking element 44 of the pull 14 to be hereinafter described. In the preferred embodiment shown in FIGS. 1–4, the apertures 40 and 42 are located within the back flange 24 of the front panel 12; however, it should also be recognized that the apertures 40 and 42 may also be located on the pull 14 by interchanging their positioning with the locking element 44. The apertures 40 and 42 are preferably rectangular in shape; however the specific shape may also vary. Furthermore, while the back flange 24 is provided with two apertures, the specific number of apertures may vary.

The pull 14 has an inverted J-shaped body in cross section. A vertically extending front portion 50 forms a hand grasp for a user. A horizontally extending middle portion 52 extends from the front portion 50 to a vertically extending rear portion 54 depending from a rear section 56 of the middle portion 52. The rear portion 54 is spaced apart from and coplanar with the front portion 50. The rear portion 54 has a length substantially greater than the length of the front portion 50. In a preferred embodiment, the pull has ¼ inch front portion 50, a ½ inch middle portion 52 and a 2½ inch rear portion 54. When the pull 14 is attached to the front panel 12, a 1 inch gap is formed between the pull 14 and the front panel 12 for user to insert their fingers.

A locking element 44 is attached to either the back flange 24 of the front panel 12 or the rear portion 54 of the pull 14 and the apertures 40 and 42 are located within the other of the back flange 24 and the rear portion 54. In a preferred embodiment, as shown in FIGS. 1–4, the locking dement 44 extends from the rear portion 54 of the pull 14 and the apertures 40 and 42 are located within the back flange 24 of the front panel 12. The locking element 44 has a first downwardly angled extension surface 60 and a second downwardly angled extension surface 61 that serve to engage the back flange 24 of the front panel 12. However, the specific number of extension surfaces may be varied. Each extension surface of the locking element 44 has a downwardly angled first surface 62 extending from the rear portion 54 of the pull 14. A vertically extending second surface 64 depends from a back edge of the first surface 62. A downwardly angled third surface 66 depends from a bottom edge of the second surface 64.

The cabinet 10 including the front panel 12 and the pull 14 is preferably formed from 18 gauge steel using a cold-rolled process of manufacturing. By separately preparing the front panel 12 and the pull 14, the manufacturing processes are greatly simplified. Moreover, it is an important aspect of the present invention that the pull 14 may be made from other materials. In particular, various plastics and types of wood may be used to create the specific preferred appearance for the pull 14 that a user may desire. Similarly, different colored plastics or wood materials may be used to create different accenting colors for the pull 14 relative to the cabinet 10. In a preferred embodiment using a wood pull, the wood is configured to form the front portion 50 and the middle portion 52 of the pull 14. The wood material is then affixed to the rear portion 54 of the pull 14 which may be made from cold-rolled steel as described-above.

In order to assemble the drawer front, a first pull 14 is inserted onto the front panel 12 by securing the locking elements 44 to the back flange 24 of the front panel 12. A user would simply grasp the front portion 50 of the pull 14 and position pull 14 such that the locking element 44 is within the apertures 40 and 42. By pushing down on the pull 14 when the locking element 44 is within the apertures 40 and 42, the locking element 44 engages the rear surface of the back flange 24 in a snap-fit relationship. In this arrangement, the rear portion 54 of the pull 14 is substantially parallel to the front wall 16 and abuts the back flange 24. In order to remove the pull 14 to thereby replace it with a different pull, a user would simply place an upward vertical force on the front portion 50 of the pull 14 thereby disengaging the locking element 44 from the rear surface 18 of the back flange 24. By moving the pull horizontally, the locking element 44 passes beyond the apertures 40 and 42 thereby freeing the pull 14 from the back flange 24. A user could then repeat the above-described assembly step in order to affix a second pull onto the front panel 12.

The embodiment described above is illustrative and not restrictive. The scope of the invention is indicated by the claims rather than by the foregoing description. The invention may be embodied in other specific forms without departing from the spirit of the invention. For example, in the embodiments of FIGS. 1–4, the locking element 44 extends from the pull 14 and the back flange 24 of the front panel 12 has an aperture therein. It should be recognized that the locking element 44 could also be placed on the back flange 24 of the front panel 12 with the corresponding apertures located within the pull 14. In addition, the specific configuration of the locking element 44 could also be varied without departing from the spirit of the invention. Accordingly, these and all other changes which come within the scope of the claims are intended to be embraced therein.

We claim:

1. A drawer front comprising;

a front panel having a front wall with a top flange extending rearwardly from a top portion of said front wall and a back flange extending downward from said top flange; and a pull having a generally inverted J-shaped cross-section being attached to said front panel which comprises a front portion for a user to grasp with his fingers, a rear portion spaced apart from said front portion, a middle portion interconnecting said front portion and said rear portion, and a locking element attached to one of said back flange of said front panel and said rear portion of said pull and a first aperture on the other of said back flange of said front panel and said rear portion of said pull, said locking element is received within said aperture and secured to said back flange in a snap-fit relationship to thereby secure said pull to said front panel.

2. The drawer front of claim 1 wherein said locking element extends from said rear portion of said pull and said first aperture is within said back flange of said front panel.

3. The drawer front of claim 2 wherein said locking element comprises a first extension that passes through said first aperture of said back flange of said front panel and is releasably secured to said back flange of said front panel.

4. The drawer front of claim 3 wherein said first extension has a first surface extending substantially horizontally from said rear portion of said pull, a vertically extending second surface depending from a bottom edge of said first surface and a downwardly angled third surface depending from a bottom edge of said second surface.

5. The drawer front of claim 4 wherein said locking element further comprises a second extension extending from said rear portion of said pull and a second aperture within said back flange of said front panel.

6. The drawer of claim 5 wherein said first aperture and said second aperture are substantially rectangular.

7. The drawer of claim 6 wherein said rear portion of said pull and said back flange of said front panel abut each other.

8. A drawer front comprising:

a front panel having a front wall with a substantially horizontally extending top flange extending back from said front wall and a substantially vertically extending back flange extending downward from said top flange; and a pull having a generally inverted J-shaped cross-section being attached to said panel front which comprises a substantially vertically extending front portion for a user to grasp with his fingers, a substantially vertically extending rear portion spaced apart from said front portion having a length greater than said front portion, a substantially horizontally extending middle portion interconnecting said front portion and said rear portion, and a locking element attached to said rear portion of said pull and a first aperture on said back flange of said front panel, said locking element received within said aperture and secured to said back flange in a snap-fit relationship to thereby secure said pull to said front panel.

9. A drawer front comprising:

a front panel having a front wall with a top flange extending back from said front wall and a back flange extending downward from said top flange; and a pull having a generally inverted J-shaped cross-section being attached to said panel front which comprises a front portion for a user to grasp with his fingers, a rear portion spaced apart from said front portion having a length greater than said front portion, a middle portion interconnecting said front portion and said rear portion, and a locking element attached to said rear portion of said pull and a first aperture on said back flange of said front panel, said locking element received within said aperture and secured to said back flange in a snap-fit relationship to thereby secure said pull to said front panel.

10. The drawer front of claim 9 wherein said front wall of said front panel is substantially coplanar with said front portion of said pull.

11. The drawer front of claim 10 wherein said front wall of said front panel is directly beneath and spaced apart from said front portion of said pull.

12. The drawer front of claim 11 wherein said rear portion of said pull is substantially parallel to said front wall of said front panel.

13. The drawer front of claim 12 wherein said rear portion of said pull abuts said back flange.

* * * * *